United States Patent [19]

Gallusser et al.

[11] Patent Number: 4,666,222

[45] Date of Patent: May 19, 1987

[54] GROUNDED CONTACT CONNECTOR

[75] Inventors: David O. Gallusser, Oneonta; Stephen Punako, Bainbridge, both of N.Y.

[73] Assignee: Allied Corporation, Morristown, N.J.

[21] Appl. No.: 793,610

[22] Filed: Oct. 31, 1985

[51] Int. Cl.[4] ..... H01R 4/66

[52] U.S. Cl. ..... 339/14 R; 339/217 R; 29/839

[58] Field of Search ..... 339/14 R, 143 R, 147 R, 339/217 R; 333/181-185; 29/839

[56] References Cited

U.S. PATENT DOCUMENTS

| | | | |
|---|---|---|---|
| 3,158,424 | 11/1964 | Bowen | 339/217 |
| 3,200,355 | 8/1965 | Dahlen | 339/217 S X |
| 3,227,993 | 1/1966 | Bentley | 339/217 S X |
| 3,397,389 | 8/1968 | Lawrence | 339/217 R X |
| 3,409,863 | 11/1968 | Culver | 339/217 R |
| 4,421,378 | 12/1983 | Sanford et al. | 339/217 R |

*Primary Examiner*—Eugene F. Desmond
*Attorney, Agent, or Firm*—C. D. Lacina

[57] ABSTRACT

A conductive insert assembly is mounted in a metal shell to retain and ground out unwanted electrical signals between two or more coaxial terminals, the grounding arrangement including a cylindrical metal retention clip being carried in each passage of an array of through passages, the clip including a spring finger that establishes a first electrical circuit contact with an axial end face of the terminal, and a stiff protuberance and a resilient wing that extend radially inward to captivate and establish a second electrical path with the outer periphery of the terminal, the retention clip being captivated within a pair of conductive planar members.

9 Claims, 6 Drawing Figures

GROUNDED CONTACT CONNECTOR

This invention relates to a connector having means for grounding a pair of terminals mounted therein and, more specifically, to a conductive insert assembly for retaining and grounding out unwanted electrical signals between two or more coaxial terminals.

An electrical connector assembly generally includes two metal shells that are coupled together by a coupling ring rotatably mounted on one of the shells, the coupled connector assembly electrically interconnecting a plurality of cable and terminal pairs. Each shell has an insert comprised of a dielectric material for retaining and electrically isolating the terminals at the ends of each electrical cable. Connector assemblies use coaxial cables and coaxial terminals to ground out unwanted electrical signals, the cable having its outer electrically conductive braided sheath connected electrically and mechanically to the connector shell. In applications where more than one pair of coaxial cables and associated terminals are involved, it is necessary to wire together the outer braid sheaths of all of the cables to ground out unwanted external electrical signals. This is difficult and time consuming. If the grounding is not properly accomplished, the cable sheaths and connector shells will not be electrically interconnected, thereby resulting in the unwanted electrical signals affecting the electrical signal conductors within the coaxial cables.

A previous way to commonly ground the coaxial cable, the connector shell, and the terminals therein was to provide a ground plane which made intimate contact with the shell and the terminals. This ground plane, which consisted of apertures which contained spring fingers and which made intimate contact with the outer periphery of the coaxial terminal, was positioned at the interface of the insert assembly and sandwiched between the insert assembly and an interfacial seal. However, difficulty was involved in manufacturing the ground plane. Oftentimes the spring fingers would be malformed or broken off, thereby not making a proper ground circuit connection with the terminal. Further, the ground plane disposition caused difficulty in providing a uniformly flat interfacial seal, a properly bonded seal, and proper interface axial location.

For the above reasons, in applicant's patent Ser. No. 4,611,873, filed Jan. 16, 1985, entitled "Insert Assembly For Connector" and assigned to the assignee of the instant application, the specification thereof being specifically incorporated herein by reference, an insert assembly included a plastic planar member molded to a metal planar member and captivated a retention clip in a stepped bore passing through the members. The insert assembly advantageously provided a simpler apparatus for connecting together the metal sheaths of a plurality of coaxial cables. However, as noted before, should spring fingers of a retention clip not be formed properly, an electrical circuit path will not properly be completed between the shell and all of the terminals disposed within the insert assembly. Further, a potential problem of inadequate grounding is presented since one of the planar members is non-conductive.

In accordance with this invention, a metal connector shell receives an insert assembly which includes an array of through passages a plurality of conductive terminals, each passage receiving a retention clip and each terminal being terminated to a respective coaxial cable and having a retention collar. A grounding arrangement completes an electrical circuit path between each of the terminals and the shell.

In particular, each of the planar members is electrically conductive (e.g., metal, metallized plastic, or plated plastic) whereby to complete an electrical circuit path with the shell when inserted therein. The insert assembly comprises a pair of planar members each having a respective face abutting so that the array of passages in each are aligned and cooperate to define a cavity for captivating a retention clip. The retention clip is of metal and completes two electrical circuit paths between the respective terminal and the insert assembly (and thus the shell) and includes a plurality of radially deflectable spring fingers each of which extend radially inward and axially forward to contact the terminal and complete the first electrical circuit path, and a pair of curved resilient wings and a radial protuberance each being substantially coplanar and axially forward of the free end of each spring finger, the wings and the protuberance extending radially inward to contact the terminal and complete the second electrical circuit path. The wings and the protuberance provide a radial interference fit about the outer periphery of the retention collar whereby to assure secondary electrical continuity between each terminal and the shell.

The invention will not be described, by way of example, with reference to the accompanying drawings in which.

While not shown, an electrical connector assembly herein would be much as described in the aforesaid U.S. Pat. No. 4,611,813 in that an insert assembly is mounted in a hollow metal shell and in contact with the inner wall of the shell, a coaxial-type terminal is mounted in the insert assembly and includes a conductive outer periphery, a conductive center pin, and a dielectric body which isolates the conductive portions, and a coaxial cable is terminated to each terminal. Each coaxial cable has its braid conductor fit about the outer periphery of its respective terminal and a center conductor electrically connected to the conductive center pin of the terminal. The terminal in one connector shell would be adapted to mate with a complementary terminal having the same coaxial conductor construction and coaxial cable termination as described hereinabove whereby open mating to provide a grounded connector assembly.

Figure 1:
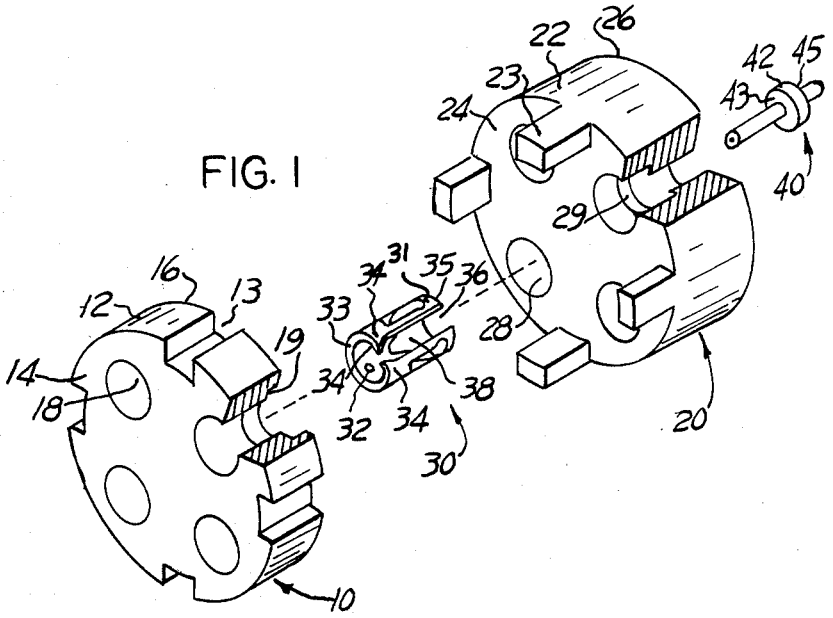
FIG. 1 is an exploded perspective view of an insert assembly.

Referring now to the drawings, FIG. 1 illustrates a conductive insert assembly which includes a conductive metal retention clip 30 and a pair of conductive planar members 10,20. A coaxial-type pin terminal 40 having a medial retention collar 42 is shown positioned for entry into the assembly.

Each planar member 10,20 includes, respectively, a front face 14,24, a rear face 16,26, an outer periphery 12,22, and an array of passages 18,28 extending axially between the faces, each array of passages being aligned and each passage being adapted to receive and captivate one retention clip 30. Each planar member would be electrically conductive (e.g., comprised of metal, metalized plastic, or plated plastic), the outer periphery 12,22 of each planar member 10,20, respectively, being adapted to be in electrical circuit path relation to the inner wall of the shell (not shown) and each of the terminals being retained by a respective retention clip 30 and be in electrical circuit relation with each of the planar members. A plurality of grooves 13 on one planar member 10 are provided to receive a corresponding plurality of locking members 23 projecting from the other planar member 20 whereby to lock the array of passages into alignment when the rear face 16 of planar member 10 abuts the front face 24 of planar member 20. The passages of each array are counter-sunk at the abutting faces 16,24 whereby to form in each passage a cavity for captivating one retention clip, the cavity being defined by a pair of axial end walls 19,29 adapted to be abutted, respectively, by the forward and rearward end faces of the clip, and an interior passage wall.

One retention clip 30 is received in in the cavity defined by the respective plurality of passage pairs formed by the planar members when the members come together and are abutted. The retention clip 30 comprises a generally cylindrical sleeve 31 including a forward end face 33, a rearward end face 35, a longitudinal slit 36 extending between the faces, a plurality of radially deflectable spring fingers 38 each extending axially forward and radially inward to a free end 39, an inward radial protuberance 32 adjacent the forward end face, and distal forward end portions 34 of the sleeve wall formed by the slit edge and the forward end face being curved radially inward whereby to form resilient wings. The slit allows the cylindrical sleeve to radially expand and contract.

Figure 2:
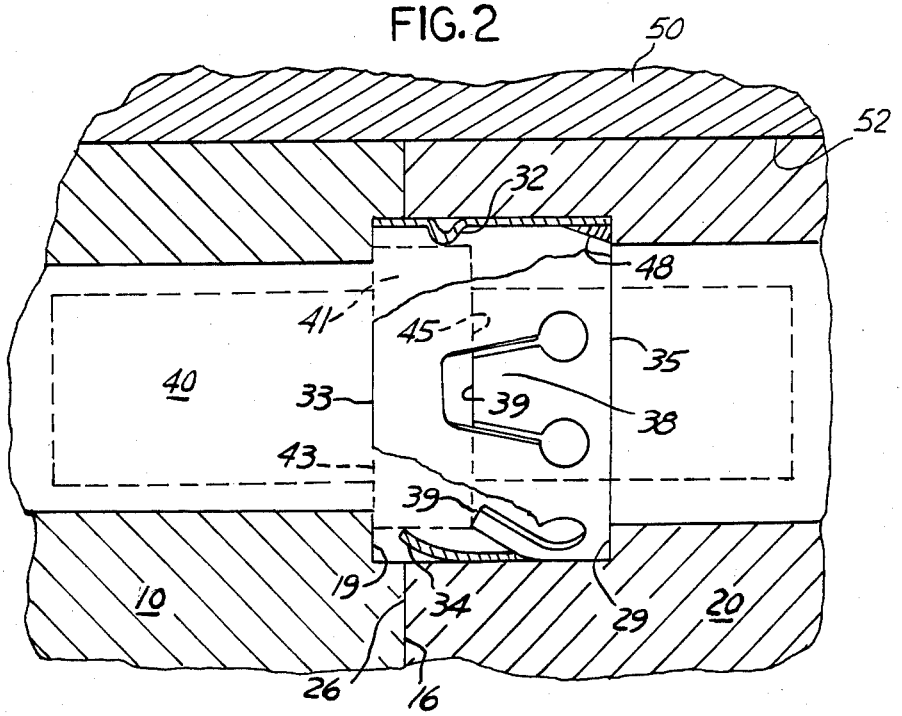
FIG. 2 is a partial cross-section of the insert assembly shown in FIG. 1 when assembled in a connector shell and showing a retention clip retaining a terminal.

FIG. 2 shows the conductive insert assembly mounted in a hollow metal shell 50 (shown in fragment). Each of the conductive planar members 10, 20 has its respective outer periphery 12, 22 in contact with the inner wall 52 of the shell. The retention clip 30 is captivated in a respective cavity formed by a passage portion from each planar member, the end faces 33,35 of the retention clip abutting against the respective axial endwalls 19,29 of the planar members 10,20 and the outer periphery of the retention clip 30 being radially expanded so as to seat against the interior wall of the cavity. The terminal 40 (shown in phantom) is seated in the passageway such that the radial retention collar 42 has its forward end face 43 seating against the axial end wall 19 of planar member 10 and its rearward end face 45 engaged by the free ends 39 of the respective resilient spring fingers 38, such seating completing an electrical circuit path with the planar members and with the shell.

The protuberance 32 is generally stiff and non-yielding and extends radially inward from the sleeve to engage the outer periphery 41 of the retention shoulder 42 and the resilient wings 34 extend radially inward to bias the retention shoulder into contact with the protuberance, the wings 34 and the protuberance 32 thereby completing a second electrical circuit path between the terminal 40 and the connector shell. Preferably, the protuberance and the resilient wings would be generally coplanar and in a plane perpendicular to an axis passing through the terminal whereby to form a radial constriction to captivate the outer periphery of the retention collar therewithin, and would be axially forward from the spring fingers.

To enhance the electrical circuit path completed between the retention clip and the insert assembly, solder 48 would be applied in the cavity of one planar member.

Figure 3:
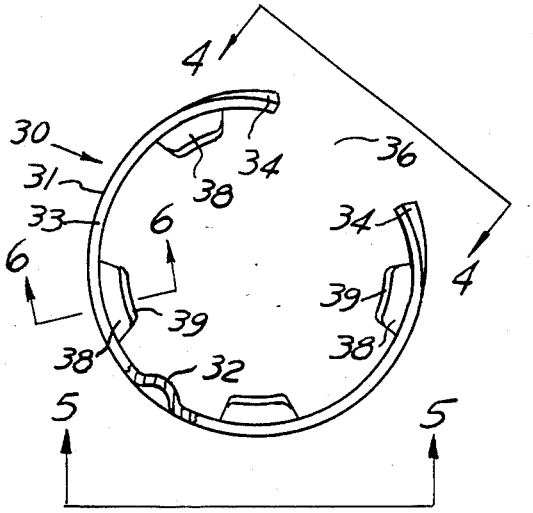
FIG. 3 is an end view of the retention clip.

FIG. 3 shows an end view of the retention clip comprising the plurality of spring fingers 38 each extending radially inward to its respective free end 39, the protuberance 32 (shown partially in section), the longitudinal slit, and the distal end portions 34 of the clip 30 being curved radially inward to form the pair of resilient wings.

Figure 4:
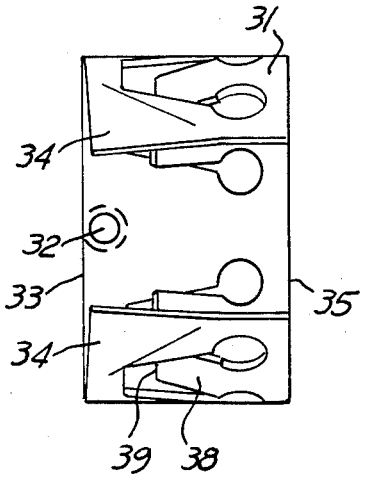
FIG. 4 is a plan view of the retention clip taken along lines 4—4 of FIG. 3.

FIG. 4 is a side view of the retention clip showing the resilient wings and the protuberance extending radially inward.

Figure 5:
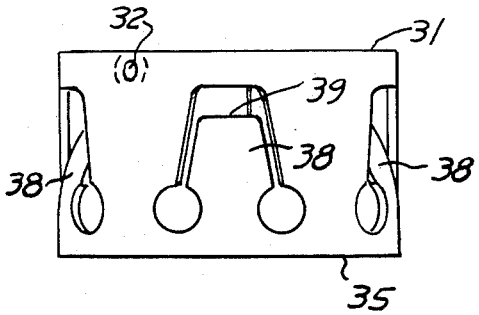
FIG. 5 is a plan view of the retention clip taken along lines 5—5 of FIG. 3.

FIG. 5 is another view taken at a different location around the retention clip.

Figure 6:
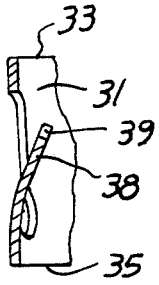
FIG. 6 is a partial plan view of the retention clip, in section, taken along lines 6—6 of FIG. 3.

FIG. 6 shows a partial section view of the retention clip and the spring finger for engaging the terminal retention shoulder.

We claim:

1. In an electrical connector of the type having a conductive hollow shell, an insert assembly mounted in said shell and having a passage extending therethrough for receiving a conductive terminal having a retention shoulder, and grounding means for electrically grounding said terminal to said shell, said grounding means being characterized by said insert assembly being electrically conductive and in electrical circuit relation to said shell, and a longitudinally slit radially contractible conductive clip being soldered in said passage, said clip comprising first contact means extending generally axially along said passage for engaging an axial face of said retention shoulder, and second contact means extending generally radially inward into said passage for engaging a circumferential face of said retention shoulder, said second contact means being spaced from said first means, and each said contact means completing an electrical circuit path between the terminal, the insert assembly, and the shell.

2. The electrical connector as recited in claim 1 wherein said second contact means comprises a relatively stiff protuberance and a resilient wing each extending radially inward from the clip and terminating at a respective free end portion, and said first contact means comprises a spring finger extending radially inward from the clip and terminating at a free end, said free end portions being being substantially coplanar and axially spaced from the free end of said spring finger.

3. The electrical connector as recited in claim 2 wherein said clip is cylindrical and has a forward end abutting the insert, a rearward end abutting the insert, the slit extending between the ends, a plurality of resilient spring fingers each extending axially forward from adjacent the rearward end and radially inward to terminate at a respective free end to engage the axial face of said retention shoulder, the outer periphery expanding radially outward and against the passage wall when inserted therein, the forward end of the clip wall forming the slit being curled radially inward to form a pair of resilient wings, and the protuberance forming a hemispherically shaped inward extension, the spring fingers defining said first contact means and the protuberance and said wings defining said second contact means.

4. An electrical connector assembly and grounding means for grounding a terminal thereto, said connector assembly comprising a hollow metal shell, a conductive terminal including a retention collar having a rear face, a front face, and a circumferential face, and an insert assembly mounted in and in electrical relation to said shell and captivating in a cavity thereof a conductive retention clip for retaining the terminal in the insert assembly, characterized in that the grounding means comprises said insert assembly being formed of a conductive material and in electrical circuit relation to said shell, said retention clip being soldered in electrical circuit relation to said insert assembly and including conductive first means extending generally axially forward and radially inward therefrom for engaging the rear face of said terminal, and conductive second means extending generally radially inward therefrom for engaging the circumferential face of said terminal, said second means being spaced from and in electrical circuit relation with said first means.

5. The electrical connector assembly and grounding means as recited in claim 4 wherein said retention clip comprises a resilient, longitudinally slit, cylindrical sleeve, said slit allowing the sleeve to radially expand and contract whereby to seat in the cavity, said conductive first means comprises a radially resilient spring finger struck from the wall of said sleeve and extending radially inward to engage the rear face, and said conductive second means comprises a protuberance extending radially inward and a forward end portion of sleeve wall adjacent to the slit being deformed radially inward to form a resilient wing, said wing extending inward to engage the circumferential face whereby to force the retention collar into contact with the protuberance, said protuberance and wing being spaced axially from the said spring finger.

6. The electrical connector assembly and grounding means as recited in claim 5 wherein said cavity includes a pair of axial end walls, an axial passage extends through the insert assembly and the cavity therein, the retention clip has a forward end face and a rearward end face each abutting one and the other end wall of said cavity, and said retention collar has its front face abutting one said end wall and its rear face abutting the spring finger.

7. An insert assembly for an electrical connector of the type have a hollow metal shell, said insert assembly comprising a pair of planar members, an array of passages extending through the members, and retention means in each said passage for retaining a respective conductive terminal whereby each respective terminal is in electrical circuit relation with said assembly, the insert assembly characterized in that each said planar member is comprised of metal with each being abuttable against one another to form the assembly configured such that its outer periphery is in electrical circuit relation with said shell when inserted therein, and said retention means comprises a longitudinally slit radially contractible clip of conductive material being captivated between the members, said clip being disposed within the passage and each member and including an outer periphery which conforms to the inner wall of its passage, a forward and a rearward end with one and the other end abutting one respective planar member, and inward radial projections which engage the outer circumferential periphery of the terminal to complete an electrical circuit path therebetween and with the assembly.

8. A method of grounding a conductive electrical terminal to a conductive shell, said terminal being insertable within a passage extending through an insert assembly and said insert assembly being insertable within said shell and including a cylindrical retention clip comprising a hollow, longitudinally slit, resilient metal sleeve having a spring finger struck from a wall thereof, the spring finger extending radially inward therefrom to a free end for engaging the terminal, the steps characterized by:

metallizing the insert assembly, radially inwardly deforming the clip adjacent to the slit and at a location spaced angularly from the slit whereby to form a resilient wing and a radial protuberance each terminating radially inward of the clip at a respective end portion adapted to engage the outer periphery of the terminal, each said end portion being generally coplanar and spaced axially from the free end of the spring finger, soldering the retention clip into the passage, inserting a terminal into the passage whereby the outer periphery of the terminal is captivated between and engaged by the end portions of the wing and by the protuberance and an axial face of the terminal is engaged by the free end of the spring finger, and inserting the insert assembly into the shell such that each surface thereof that contacts the shell and said terminal are in electrical circuit relation.

9. An electrical connector for a conductive terminal, the connector comprising a hollow metal shell, retention means including a longitudinally slit conductive retention clip for retaining the terminal in the shell, and insert means for establishing electrical circuit relation between the terminal and the shell, characterized in that said insert means comprises a pair of conductive planar members each having a passageway extending therethrough and being abutted to form an insert assembly wherein the passageways combine to form an enclosed cavity for receiving and abutting the opposite ends of the clip, the outer periphery of the assembly being configured to make electrical contact with the inner wall of the shell, and said retention clip deforming its forward end portion whereby a stiff protuberance and a resilient wing extend radially inward to make contact with the outer periphery of the terminal and its rearward end portion whereby a spring finger extends radially inward to make electrical contact with an axial face of the terminal.

* * * * *